US007417556B2

(12) United States Patent
Ling

(10) Patent No.: US 7,417,556 B2
(45) Date of Patent: Aug. 26, 2008

(54) WIRELESS ADDRESSABLE LIGHTING METHOD AND APPARATUS

(75) Inventor: Wang Ling, Millwood, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 1486 days.

(21) Appl. No.: 09/841,665

(22) Filed: Apr. 24, 2001

(65) Prior Publication Data

US 2002/0154025 A1 Oct. 24, 2002

(51) Int. Cl.
*G08C 19/00* (2006.01)

(52) U.S. Cl. ..... 340/825.69; 340/825.75; 340/825.22; 340/3.7; 340/3.1; 340/5.1; 341/176; 315/314; 315/318

(58) Field of Classification Search ..... 340/825.22, 340/825.69, 825.72, 3.1, 3.7, 5.1; 341/176; 315/312, 314, 315, 294, 308, 317, 318
See application file for complete search history.

(56) References Cited

U.S. PATENT DOCUMENTS

| | | | | | |
|---|---|---|---|---|---|
| 5,295,154 | A * | 3/1994 | Meier et al. | ..... | 370/351 |
| 5,847,955 | A * | 12/1998 | Mitchell et al. | ..... | 364/191 |
| 5,936,362 | A * | 8/1999 | Alt et al. | ..... | 315/312 |
| 5,962,992 | A * | 10/1999 | Huang et al. | ..... | 315/312 |
| 6,163,275 | A * | 12/2000 | Hartzell | ..... | 340/825.72 |
| 6,188,181 | B1 * | 2/2001 | Sinha et al. | ..... | 315/293 |
| 6,333,605 | B1 * | 12/2001 | Grouev et al. | ..... | 315/291 |
| 6,507,306 | B1 * | 1/2003 | Griesau et al. | ..... | 341/176 |
| 6,509,841 | B1 * | 1/2003 | Colton et al. | ..... | 340/870.11 |
| 6,675,196 | B1 * | 1/2004 | Kronz | ..... | 709/203 |

* cited by examiner

*Primary Examiner*—Brian Zimmerman
*Assistant Examiner*—Vernal Brown

(57) ABSTRACT

An improved technique of utilizing a centralized control protocol for lighting devices such as DALI. A technique is disclosed for utilizing such protocols in a wireless environment. The first step involves associating particular slave devices with a specified master control device, and a second step involves associating specific functions within the master device with specific slave devices.

20 Claims, 4 Drawing Sheets

WIRELESS ADDRESSABLE LIGHTING METHOD AND APPARATUS

TECHNICAL FIELD

This invention relates to home, office, and commercial lighting and appliance systems, and more particularly, to an improved technique of interfacing a master control computer to a plurality of slave computers such as appliances and lighting devices dispersed throughout a home or office.

BACKGROUND OF THE INVENTION

Home and office centrally controlled lighting systems are known in the art. One such system is known as DALI (Digital Addressable Lighting Interface). DALI is a widely accepted standard for lighting controls. In a DALI system, a plurality of lighting devices are dispersed throughout a site, such as a home or office, and are controlled by an intelligent control unit or central computer. The plurality of lighting devices may be termed "slaves" and the central control computer is denoted a "master".

In most prior art systems such a DALI, the connections between the master and the slave is in the form of hardwiring. In the present art, a DALI type system is usually used for the lighting in one room, i.e. master and slave are in the same room. By adding a gateway to each DALI control unit, a building-wide control system can be built. Introducing wireless lighting control is to eliminate the wires that have to be installed inside the walls or ceilings, which creates obstacles for retrofit in most old buildings.

Wireless control of a lighting system in a commercial or office building can bring a number of advantages to the building owners, users and lighting system manufacturers. Wireless control can be achieved by communicating between the master and slave utilizing radio frequency (RF) technology. RF technology however, poses obstacles of its own that are not present in a hardwired system. More specifically, in order to take the advantage of RF technology, the wireless lighting control system must employ a technique to combine the operation of standards such as DALI with RF communication protocol standards.

The current state of the art however, only includes solutions for hardwired lighting networks implementing DALI standard. There is no technique to extend DALI standard to manage plural wireless slaves. Most current available wireless lighting control systems use proprietary protocols instead of DALI. Additionally, the DALI protocol, and similar protocols, operate by assuming reliable communication between master and slave. These protocols assume for example, that every transmitted bit from every slave device will be reliably and timely received by the master without interference from other slave devices in the system. The DALI protocol also assumes that all information from the master will be correctly received by the proper slave device. The protocol does not provide for the errors, delays, and interference that may corrupt data in a wireless environment. The protocol also does not provide for a way to initialize slaves and bind the commands on the remote control master to the slaves. Binding is the process used to assign certain slaves to certain commands on the remote control master dynamically.

SUMMARY OF THE INVENTION

The above and other problems of the prior art are overcome and a technical advance is achieved in accordance with the present invention. The present invention uses a technique to bind the master to plural slaves that requires registration of each of the slaves with the master. A user confirmation step by a user of each slave is added to the initialization process to ensure that the right slaves are initialized with the master.

In a preferred embodiment, a first step is executed to ensure that the specific slave devices to be controlled by a specified master device are initialized (i.e.; associated with that particular master device). After the specific desired devices are so associated, the system then associates specific functions or key sequences on a remote control or similar device in order to permit the same remote control device to communicate in a wireless fashion with plural slave devices. Thus, each slave device is ultimately associated with a particular function of a particular master device. In a preferred embodiment, a standardized network protocol is used in conjunction with a DALI or similar protocol.

DETAILED DESCRIPTION OF THE PREFERRED EMBODIMENT

Figure 1:
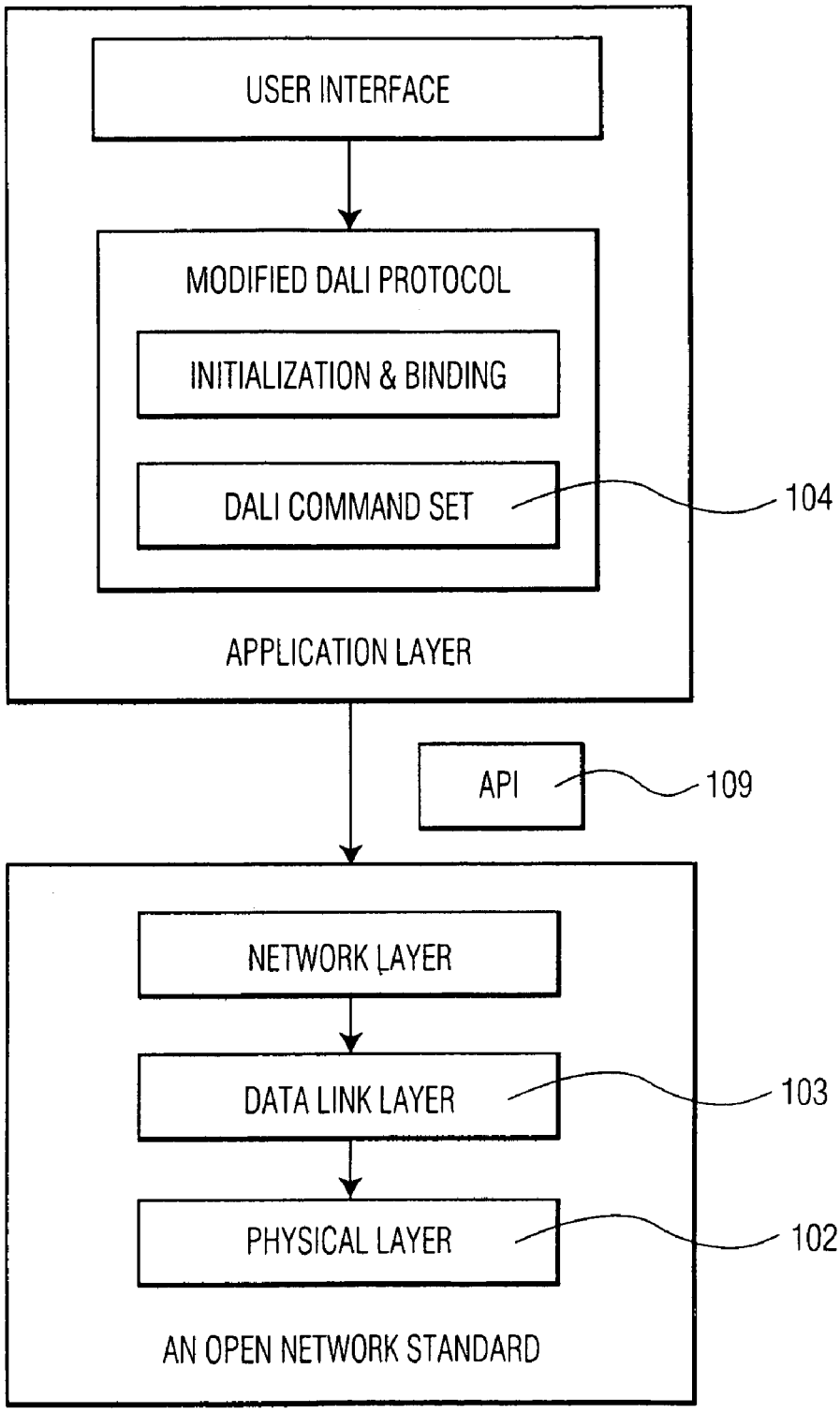
FIG. 1 depicts a conceptual diagram of an exemplary system of the present invention using a modified DALI protocol to achieve wireless operation.

FIG. 1 shows a conceptual diagram of an exemplary embodiment of the present invention. The arrangement in FIG. 1 is intended to represent use of the techniques of the present invention in a master control computer, such as a remote control device that would be utilized in a wireless embodiment. The computer includes an application software layer 110 which communicates utilizing the modified version of the DALI protocol 114. The lower communications layers are shown as 132,134,136, but the particular techniques utilized therein are not critical to the present invention.

Figure 1A:
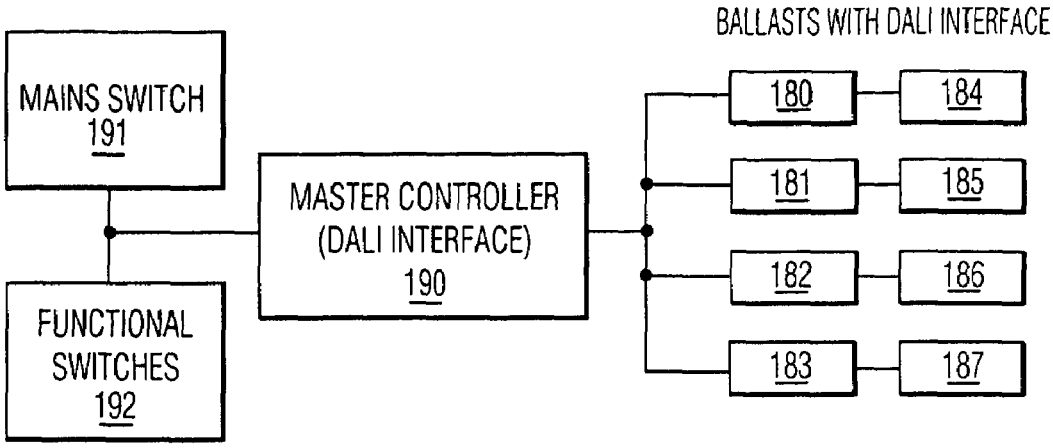
FIG. 1A shows a prior art hard wired system using a DALI interface.
Figure 1B:
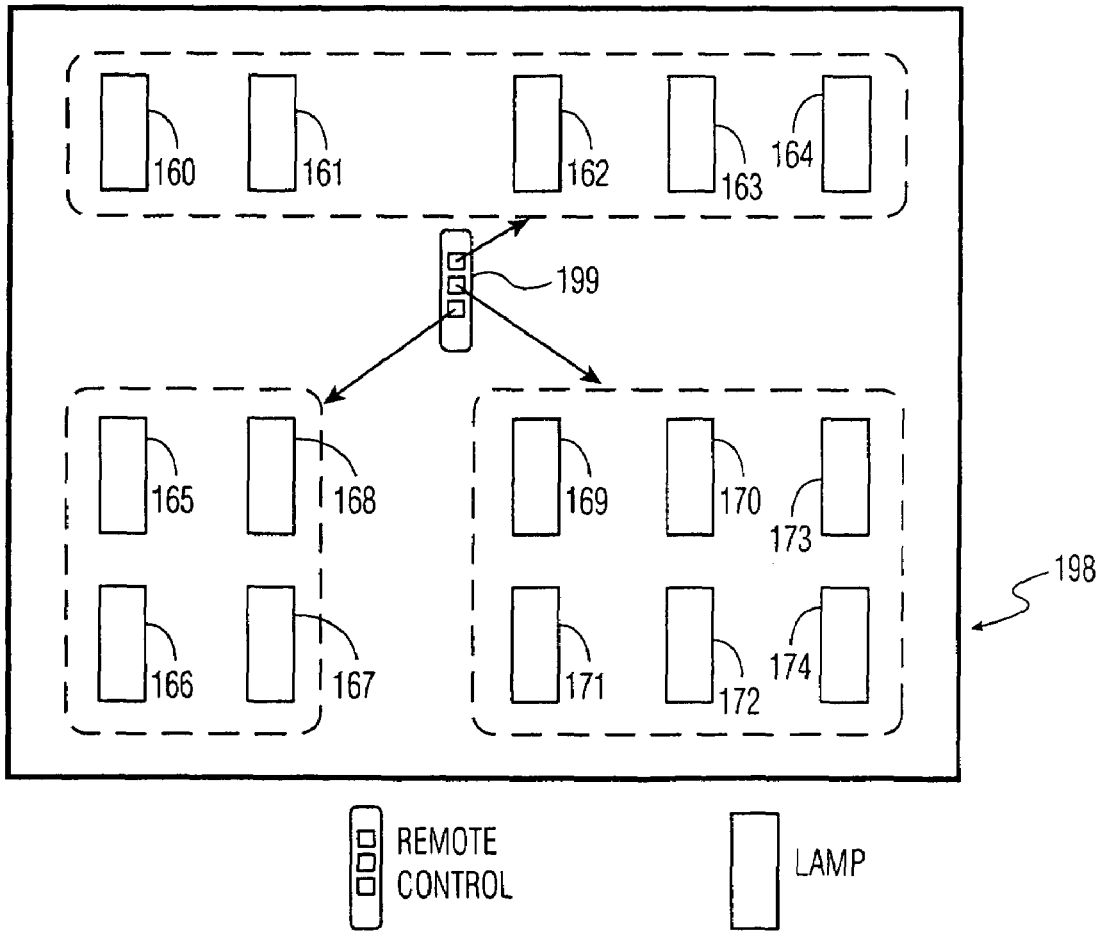
FIG. 1B is a conceptual diagram of a wireless lighting control system using a DALI type of protocol.

FIG. 1A depicts a representation of a conventional DALI type of lighting standard as used in a practical system. As shown therein, a series of switches 191-192 interface with a master controller 190 to plural ballasts with DALI interface on board 180-187. FIG. 1B depicts a wireless system 198, with a central controller 199 (e.g. a remote control) and plural slave devices 160-174 as indicated therein. Each button shown on the central controller controls different group of slave devices.

The physical layer 136 of FIG. 1 and data link layer 134 can be built using an open standard such as Bluetooth, RF lite or any other network standards available in the future for low power low cost wireless data networks. Such standards provide for the reliable transfer of information across the physical link; with the necessary synchronization, error control, and flow control. Then a standardized command set such as a DALI command set layer 118 can be stacked above the physical layer 136, and data link layer 134 and network layer 132 as shown. The system also includes an optional applications programming interface (API) 120 as shown.

The DALI command set 118 translates commands entered at the application level to DALI commands. With a fully functional data-link-layer protocol, the next higher layer, DALI command set layer, may assume error-free transmission over the link. Therefore, the lower three layers can be transparent to the DALI command set and higher layers. This gives enormous flexibility in adopting different open standards to meet different requirements for different applications without changing the command set and user interface 112. For example, if the wireless lighting control network is targeted to a home environment, it requires short range and low power radio. If it is for an office or commercial building, it may require a longer communication range and more addressable nodes. Based on these application requirements, different open standards can be selected and implemented as the lower two layers in this model.

Returning to FIG. 1, prior to utilization of the DALI protocol, an initialization procedure 116 must take place and a short address is assigned to the slave. Each slave, such as a lighting device (e.g., ballast), must register with the master in order to communicate with the master, and to exchange control signals.

Figure 2:
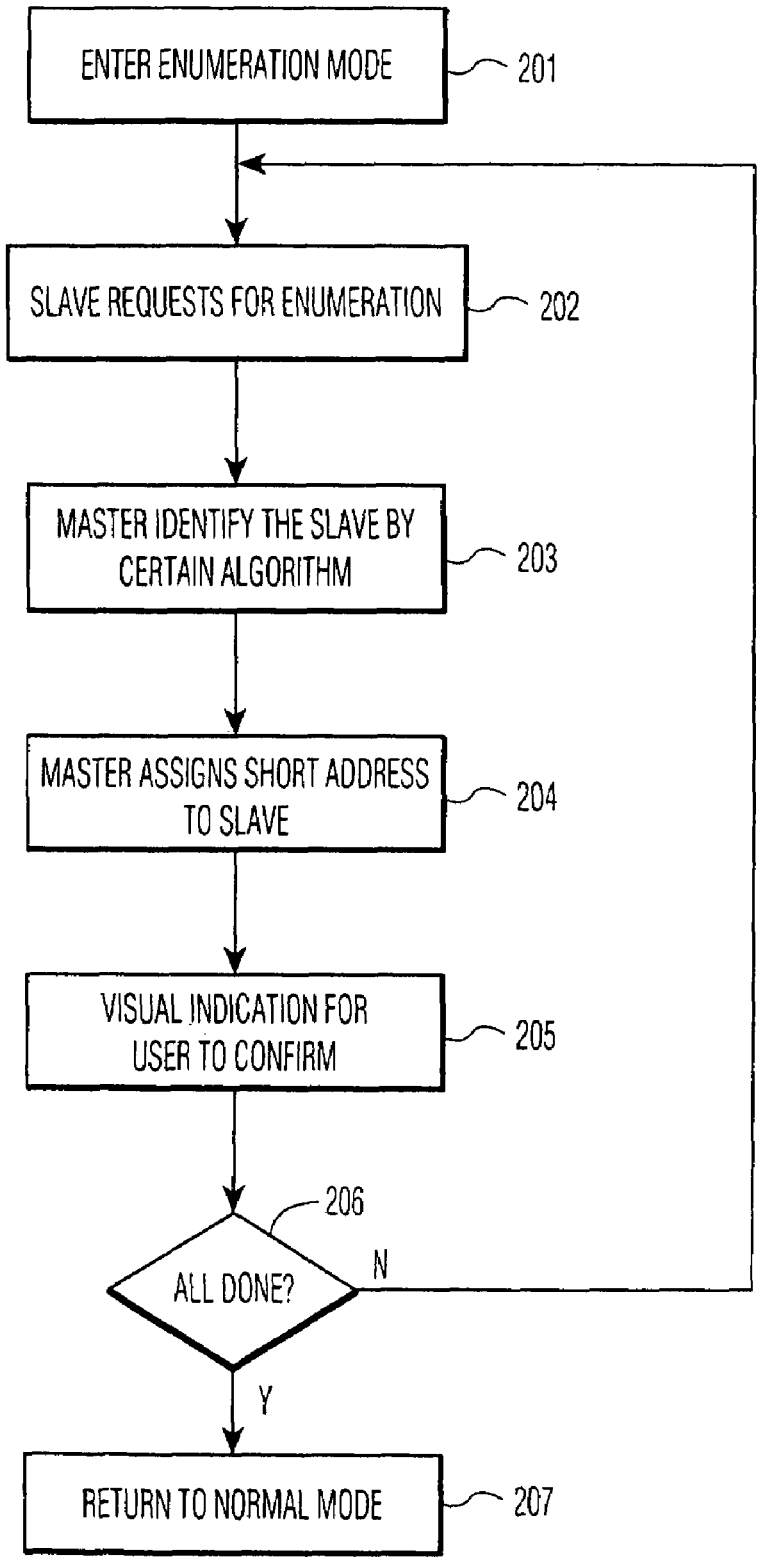
FIG. 2 depicts a flow chart of the high level functional steps representing an exemplary embodiment of the present invention.

FIG. 2 shows the technique, in accordance with an exemplary embodiment of the invention, for associating each of the slave devices with a particular master device/remote control. A special enumeration mode is entered in block 201 and a request for enumeration is made, at block 202, to the master. An algorithm is utilized in block 203 to identify the slave. This algorithm may consist of any technique such as, sequential holding by the master of all the slaves, transmitting a signal to the slave and awaiting a response, etc. Once the particular slave is identified, the master assigns a short address at block 204 in accordance with the DALI protocol, or other such technique. The master (e.g. a remote control) is then utilized to confirm a visual indication from the slave. For example, once an address is assigned to the slave by the master, the slave may blink of f and on in certain sequence for a certain number of times. Whatever signal is agreed upon, the user then responds with a particular confirmation signal, such as depression of a specific key on a keypad.

The foregoing confirmation step indicates that the user confirms that the particular device signaling visually is to be associated with the particular master device. Decision point 206 then returns the program to block 202 to process a new slave device. When all the slave devices have been processed so that they were associated with the proper master, the system returns to normal operation mode at 207.

Depending on the open network standard 130 used in the system, the master has to identify the slave by a predetermined algorithm. If the open network standard has its own enumeration procedure or algorithm defined, then the only work the master needs to do is to get the new device information through an API (application programming interface) 120 and utilize this information to proceed with the next steps in the initialization.

If the open network standard does not have an enumeration procedure defined or the slave devices don't have pre-programmed identifiers, the master needs to go through a searching algorithm to discover each slave. An example of such a searching algorithm can be the modified version of the initialization algorithm specified in DALI standard. It is a binary searching scheme to locate the smallest random address in each round of the search. The modification to be made is to implement CSMA (Carrier Sense Multiple Access) technique to avoid the collision that might happen when two or more slaves try to respond to the master's query. The collision problem is particular to a wireless system. It does not create problems during the searching procedure for the wired connections, since even if two or more slaves respond at the same time the master would be able to recognize the overlapped signals on the input line therefore determine that at least one slave is responding.

Once the master identifies the slave and the master updates its stored data in a manner such that it communicates with the new slave device at the assigned short address, an indication is awaited from the user which confirms the assignment of the address. The slave device gives visual feedback, for example, the lamp can flash or blink off, to let the user confirm if this is the right slave that is supposed to be in control of this particular master. Due to the penetration characteristics of RF signals, this step is preferred because any slave in the RF sphere of influence could be included in the control of the master even though it is not supposed to. For example, a lamp in a room on a different floor can be mistakenly initialized to join the network of the master of the room upstairs. The user must, for example, press a button to confirm that the slave device indicating is the right one to include.

Figure 3:
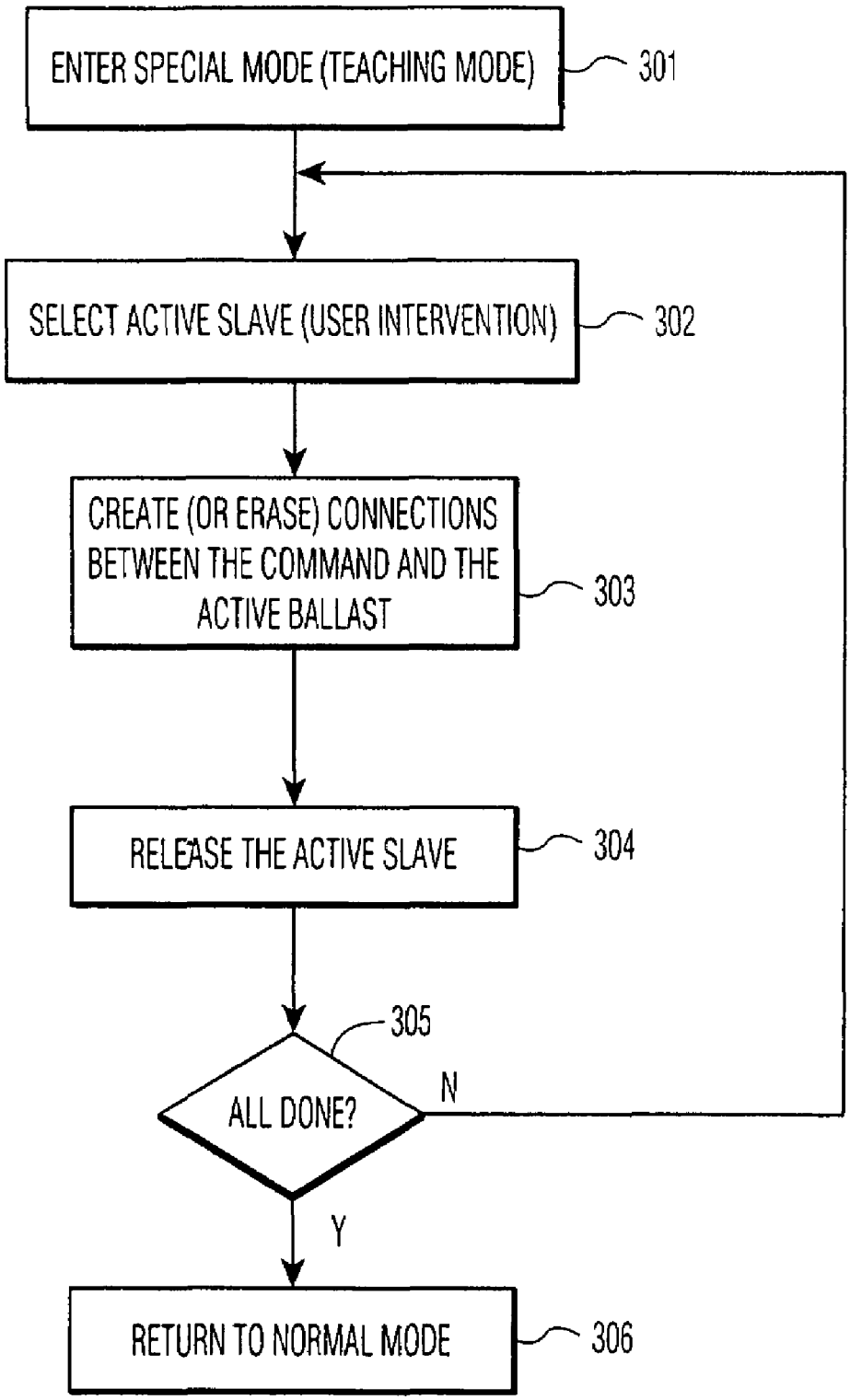
FIG. 3 shows the steps to be executed for the purpose of associating each of plural slave devices with a specific function or key sequence on a wireless master remote control device.

The concept of binding specific functions on a remote control to specific lighting devices is also addressed in a wireless environment by the present invention. The flowchart of FIG. 3 is entered at 301 in which the special teaching mode, or binding mode, is entered. At 302, an active slave is selected either automatically, or by the depression of a key on the remote control, based on the slave list that the master obtained during the initialization procedure. The slave feeds back with a visual indication so that the user knows which device is active at the current moment. At such a time, an association is formed at 303 between master and the particular selected slave, for example, by the depression of a key on the remote control by the user. The slave is then released at block 304, and decision point 305 checks to determine if any other slaves must be bound with specific function keys. If so, a new active slave is selected, and the process repeats itself until each slave is "bound" with a particular function key or sequence of keys.

This binding process permits the flexibility of one button (or one command) to be associated to different slave devices dynamically after initialization. More specifically, in hard-wired systems, the master may direct commands and information to a particular lighting device by simply transmitting the command or data over the physical wire connected to the particular lighting device. However, in a wireless system, the RF command would be received by all lighting devices since the wired protocols, such as DALI, were not designed in the first place to support wireless communications.

By first performing the foregoing binding procedure, each of the slave lighting devices is associated with a particular function or key sequence on the master (e.g. a remote control). In this manner, when commands and data are exchanged between the slave lighting device and the master, no conflict among the various slaves results. More specifically, the particular function or key sequence directs the exchange of information to a specific lighting device.

Another issue that arises as a result of the use of wireless communications in a master slave lighting system such as DALI is the identification of which slave devices are intended to be controlled by a particular master device, such as a remote control. This situation arises, for example, in an office environment wherein there could be one master controlling plural slave devices on the first floor, and a different master controlling slave devices an a second floor. In a hard wired system, the master will know which slaves are under its control simply by the particular hard wired connections between the various slave devices and the master. In a wireless environment, there needs to be a technique of ensuring the master only controls its own slaves.

As shown above therefore, in wireless environment two distinct steps are required in order to permit correct operation of the wireless lighting protocol such as DALI. In the first step, each of the slaves must be associated with a particular master, and in the second step, specific keys, buttons or functions on the master must be associated with each particular slave. Generally, these steps are accomplished by having the master pull the slaves in order to ascertain which slaves should be associated with the particular master, and then specific functions are activated so that particular slaves may be associated with those particular functions or keys.

What is claimed is:

1. A method of controlling plural lighting devices with a single remote control comprising the steps of:

associating, one by one, each of the plural lighting devices with the remote control;

associating, one by one, each of the plural lighting devices associated with the remote control with at least one of a particular function and a particular key on the remote control; and accepting a user confirmation acknowledging the association of each of the plural lighting devices in response to a visual confirmation performed by each of the plural lighting devices upon selection of each of the plural lighting devices on the remote control.

2. The method of claim 1 wherein the plural lighting devices communicate with the remote control by means of a carrier sense multiple access protocol.

3. The method of claim 1 wherein the visual confirmation step includes a predefined sequence of on/off occurrences.

4. An apparatus for controlling plural lighting devices over a wireless connection, the apparatus comprising:

a processor for providing commands to said plurality of lighting devices over the wireless connection in a normal mode, and a means for switching between an enumeration mode and the normal mode, said enumeration mode being utilized to associate said plural devices with said apparatus in response to a visual confirmation performed by each of the plural lighting devices upon selection of each of the plural lighting devices by said processor.

5. The apparatus of claim 4 wherein said means for switching only switches upon receipt of a confirmation step from a user.

6. The apparatus of claim 4, further comprising software for binding at least one of specific functions and specific key sequences from a remote control with specific ones of said plural lighting devices.

7. A method of utilizing a wireless lighting control protocol comprising the steps of:

providing a standardized command set for facilitating command and control between a master device and plural slave lighting devices; and interposing a layer of software between said command set and a software application, said layer of software including means for initialization and binding of the plural slave lighting devices and the master device in response to a visual confirmation performed by each of the plural slave lighting devices upon selection of each of the plural slave lighting devices on the master device.

8. The method of claim 7 further comprising the step of polling each of the slave devices individually and sequentially to thereby associate each of said slave devices with said master device.

9. A method of associating each of plural slave devices with a master remote control comprising the steps of:

communicating a visual signal at each of the slave devices indicating the presence of each of said slave devices upon selection of each of the slave devices on the master remote control, and accepting a user confirmation acknowledging that said device is to be associated with at least one of said master remote control, a particular function of said master remote control, and a particular key sequence of said master remote control.

10. The method of claim 9 wherein said master and each of said slave devices communicate utilizing a Digital Addressable Lighting Interface (DALI) standard protocol and a wireless communications channel.

11. The method of claim 1, wherein the lighting devices communicate with the remote control using a Digital Addressable Lighting Interface (DALI) protocol.

12. The method of claim 11, wherein:

the DALI protocol is supported by an application layer; and the remote control comprises a network layer, a data link layer, and a physical layer that are transparent to the application layer.

13. The method of claim 12, wherein the data link layer and the physical layer support Bluetooth communications with the lighting devices.

14. The apparatus of claim 4, wherein the processor is capable of identifying at least one of the devices and assigning a short address to the at least one identified device while in the enumeration mode.

15. The apparatus of claim 14, wherein:

at least one of the devices is capable of providing a visual indication when the short address is assigned to the device; and the processor is capable of receiving confirmation from a user in response to the visual indication.

16. The method of claim 7, wherein the master device comprises a remote control, and further comprising associating at least one of the slave devices with at least one of a particular function and a particular key on the remote control.

17. The method of claim 7, wherein initializing and binding one of the slave devices to the master device comprises assigning a short address to the slave device.

18. The method of claim 9, wherein the visual signal comprises one of the devices flashing on and off.

19. The method of claim 9, wherein the visual signal comprises one of the devices blinking off.

20. A method of associating a plurality of slave devices with a master remote control comprising the steps of:

communicating a visual signal at each of the slave devices indicating the initialization of each of said slave devices upon selection of each of the slave devices on the master remote control; and communicating a user indication at the master remote control that each said slave device is to be associated with at least one of said master remote control, a particular function of said master remote control, and a particular key sequence of said master remote control.

* * * * *